US012385646B2

(12) United States Patent
Cadima

(10) Patent No.: US 12,385,646 B2
(45) Date of Patent: Aug. 12, 2025

(54) CONTROL SYSTEMS AND METHODS FOR COOKTOP APPLIANCES

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 366 days.

(21) Appl. No.: 17/897,600

(22) Filed: Aug. 29, 2022

(65) Prior Publication Data

US 2024/0068669 A1 Feb. 29, 2024

(51) Int. Cl.
*F24C 3/12* (2006.01)
*F23N 1/00* (2006.01)

(52) U.S. Cl.
CPC ..... *F24C 3/126* (2013.01); *F23N 1/002* (2013.01); *F23N 2225/16* (2020.01); *F23N 2235/14* (2020.01); *F23N 2235/16* (2020.01)

(58) Field of Classification Search
CPC ..... F24C 3/126; F23N 1/002; F23N 2225/16; F23N 2235/14; F23N 2235/16; F23N 2237/02; F23D 23/00
USPC ..... 431/75; 137/905; 126/39 E, 39 R, 30
See application file for complete search history.

(56) References Cited

U.S. PATENT DOCUMENTS 1,445,984 A * 2/1923 Wilkinson ..... F24C 3/12 126/39 J
7,255,100 B2 8/2007 Repper et al.
9,562,686 B2 2/2017 Arenaza
9,841,191 B2 * 12/2017 Johncock ..... F23N 1/002
10,584,871 B2 3/2020 Biagioli et al.
10,619,858 B2 4/2020 Paller
10,935,250 B2 3/2021 Andueza et al.
11,098,892 B2 8/2021 Gerdes
2002/0073985 A1 6/2002 Leukhardt et al.
2019/0309954 A1 10/2019 Andueza et al.
2020/0300507 A1 9/2020 Cowan et al.
2020/0408413 A1 12/2020 Billman et al.

FOREIGN PATENT DOCUMENTS

CN 201241956 Y 5/2009
CN 109996993 B 6/2020
CN 106871168 B 9/2020
CN 111692408 A 9/2020
(Continued)

*Primary Examiner* — Vivek K Shirsat
(74) *Attorney, Agent, or Firm* — Dority & Manning, P.A.

(57) ABSTRACT

A cooking appliance includes a cooktop, a user interface provided on the cooktop, a manifold provided within the cooktop, the manifold including a gas input, a first burner supply line extending from the manifold, a second burner supply line extending from the manifold in fluid parallel with the first burner supply line, a gas burner, the gas burner including a first stage fluidly connected to the manifold via the first burner supply line and a second stage fluidly connected to the manifold via the second burner supply line, a connection line fluidly connecting the first and second burner supply lines, a connection line valve provided on the connection line between the manifold and the gas burner, and a controller operably coupled with the connection line valve, the controller being configured to selectively open the connection line valve.

18 Claims, 6 Drawing Sheets

(56) References Cited

FOREIGN PATENT DOCUMENTS

| | | | |
|---|---|---|---|
| EP | 2348255 | B1 | 7/2019 |
| FR | 3109622 | A1 | 10/2021 |
| JP | H10246424 | A | 9/1998 |
| WO | WO2020008088 | A2 | 1/2020 |

* cited by examiner

CONTROL SYSTEMS AND METHODS FOR COOKTOP APPLIANCES

FIELD OF THE INVENTION

The present disclosure relates generally to cooktop appliances, and more particularly to gas cooktop appliances.

BACKGROUND OF THE INVENTION

Temperature control in stove tops was traditionally done by an operator adjusting a relative position of a knob associated with the stove top. Over time, more precision temperature control was introduced whereby the stove top actively regulated temperature using precision flow control valves. However, these systems often suffer from long term drift and limited accuracy at the lowest as flow rates which are used for simmering functions. Moreover, these systems are expensive and require highly precise metering devices which limit general applicability.

Accordingly, improved cooking appliances are desired in the art. In particular, cooking appliances which provide relatively inexpensive solutions to temperature control without suffering from long term drift and limited accuracy would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking appliance is provided. The cooking appliance may include a cooktop; a user interface provided on the cooktop; a manifold provided within the cooktop, the manifold including a gas input and a supply valve; a first burner supply line extending from the manifold; a second burner supply line extending from the manifold in fluid parallel with the first burner supply line; a gas burner, the gas burner including a first stage fluidly connected to the manifold via the first burner supply line and a second stage fluidly connected to the manifold via the second burner supply line; a connection line fluidly connecting the first and second burner supply lines; a connection line valve provided on the connection line between the manifold and the gas burner; and a controller operably coupled with the connection line valve, the controller being configured to selectively open the connection line valve.

In another exemplary aspect of the present disclosure, a heating element assembly is provided. The heating element assembly may include a manifold including a gas input and a supply valve; a first burner supply line extending from the supply valve; a second burner supply line extending from the supply valve in fluid parallel with the first burner supply line; a multi-stage gas burner, the gas burner including a first stage fluidly connected to the first burner supply line, and a second stage fluidly connected to the second burner supply line; a connection line fluidly connecting the first and second burner supply lines; a connection line valve provided on the connection line between the manifold and the gas burner; and a controller operably coupled with the connection line valve, the controller being configured to selectively open the connection line valve.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
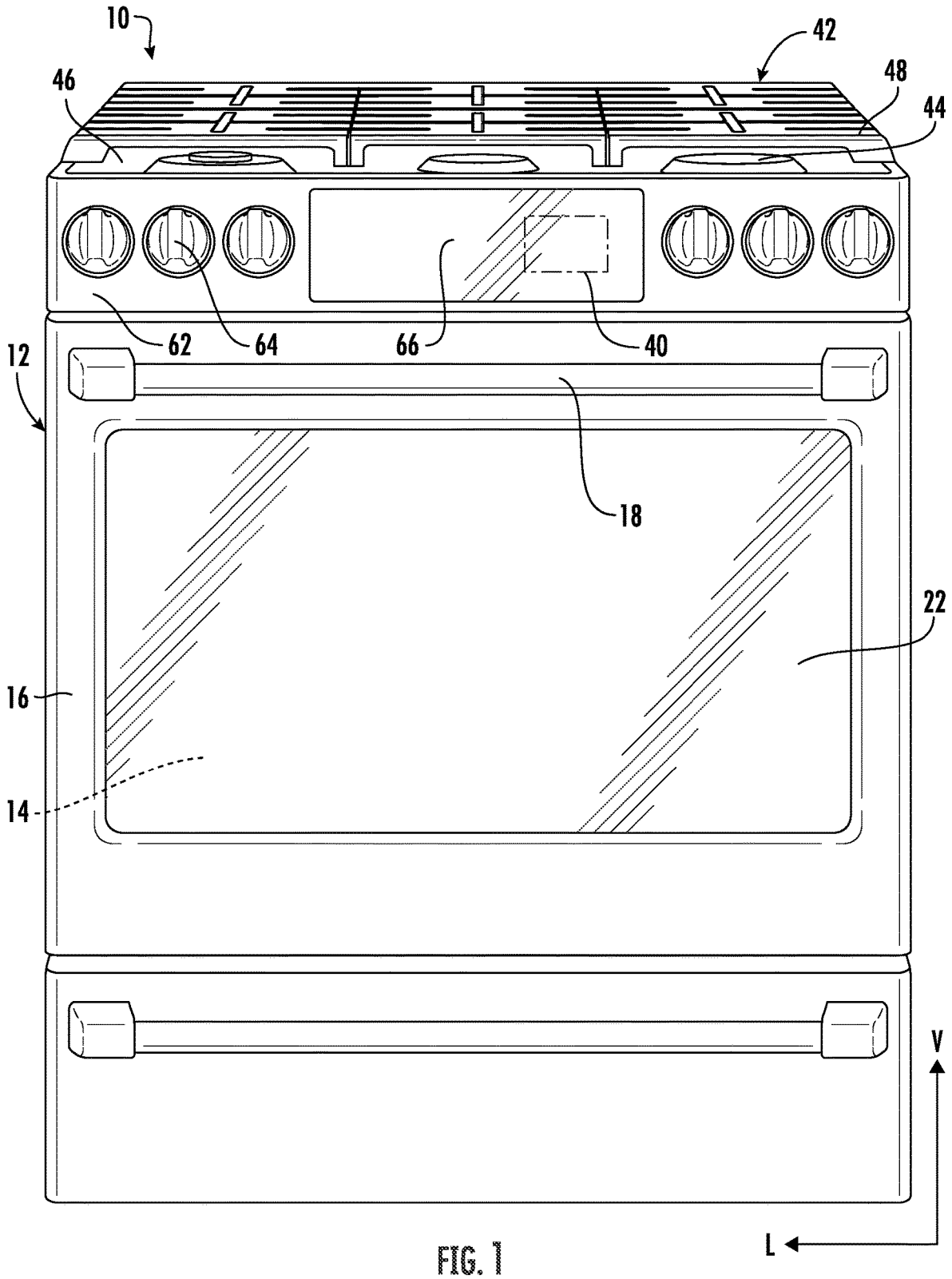
FIG. 1 provides a front perspective view of an oven-range cooktop appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a cooktop appliance 10. Cooktop appliance 10 may include a cooktop surface 42 having one or more heating elements 44 for use in heating or cooking operations. In exemplary embodiments, cooktop surface 42 is comprised of a metal (e.g., steel) panel 46 on which one or more grates 48, described in further detail below, may be supported. In other embodiments, however, cooktop surface 42 may be comprised of another suitable material, such as a ceramic glass or another suitable non-metallic material. Heating elements 44 may be various sizes, as shown in FIG. 1, and may employ any suitable method for heating or cooking an object, such as a cooking utensil (not shown), and its contents. In one embodiment, for example, heating element uses a heat transfer method, such as electric coils or gas burners, to heat the cooking utensil. In another embodiment, however, heating element 44 uses an induction heating method to heat the cooking utensil directly. In turn, heating element 44 may include a burner element, electric heat element, induction element, or another suitable heating element.

In general, cooktop appliances described herein may be gas cooktop appliances which can be switchable between automatic and manual operating modes. In manual operating mode, the operator can manually adjust flame height at a gas burner of the cooktop appliance. In automatic operating mode, the cooktop appliance, and more particularly a control system of the cooktop appliance, can control temperature at the gas burner. More particularly, the cooktop appliance can control temperature at cooking hardware being heated by the cooktop appliance when in automatic operating mode. In this regard, the cooktop appliance can control and maintain precise temperature at the cooking hardware.

Figure 2:
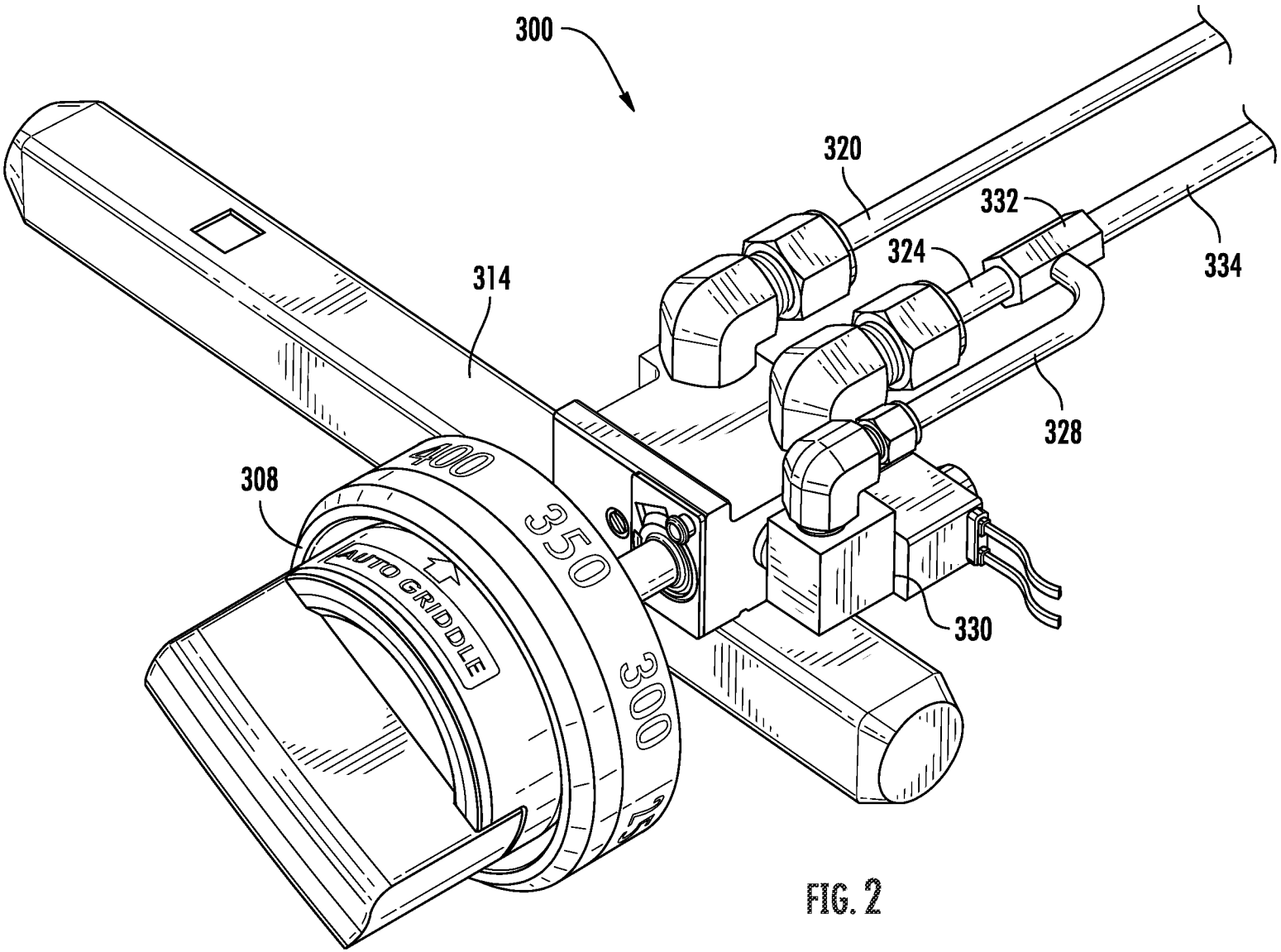
FIG. 2 is a perspective front view of a portion of a control assembly for regulating gas flow in a cooktop appliance in accordance with embodiments of the present disclosure.
Figure 3:
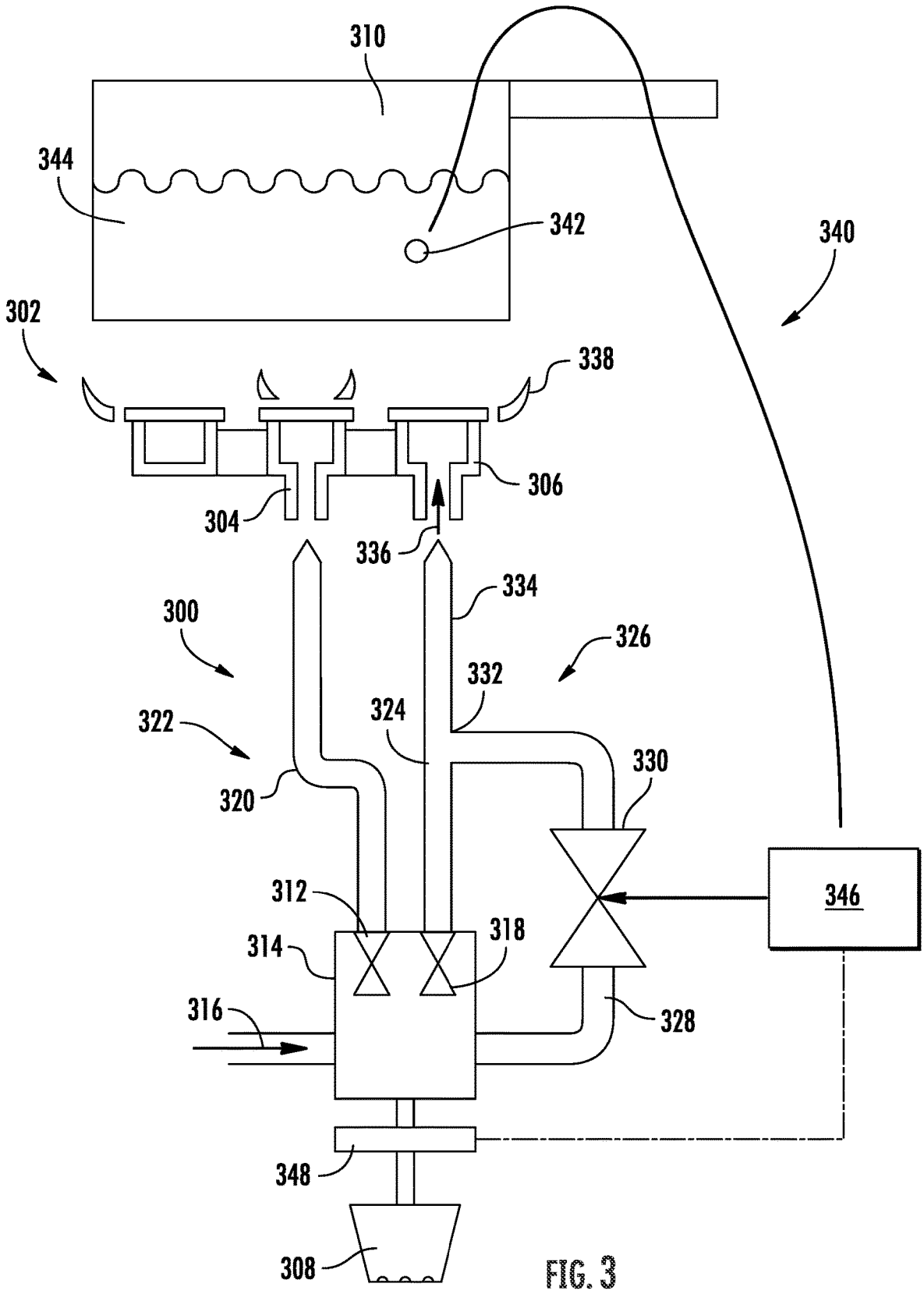
FIG. 3 is a schematic view of the control assembly of FIG. 4 in accordance with embodiments of the present disclosure.
Figure 4:
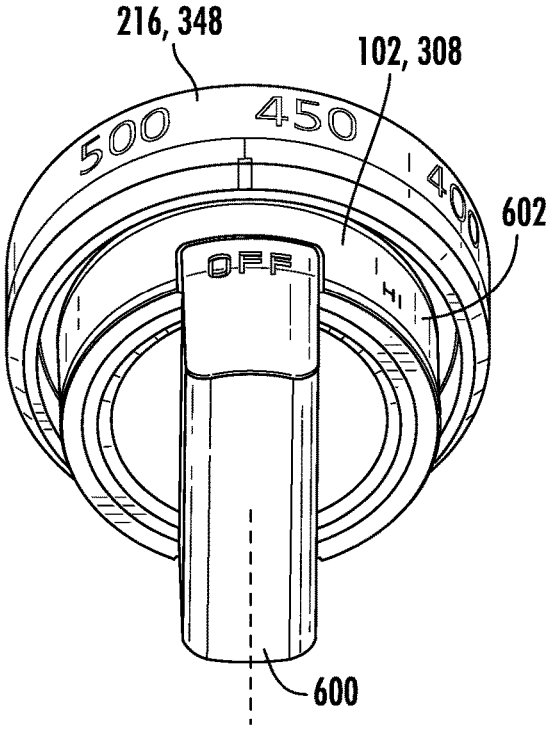
FIG. 4 is a perspective view of a knob for controlling the control assembly in accordance with embodiments of the present disclosure, as seen in a first position associated with a manual operating mode.
Figure 10:
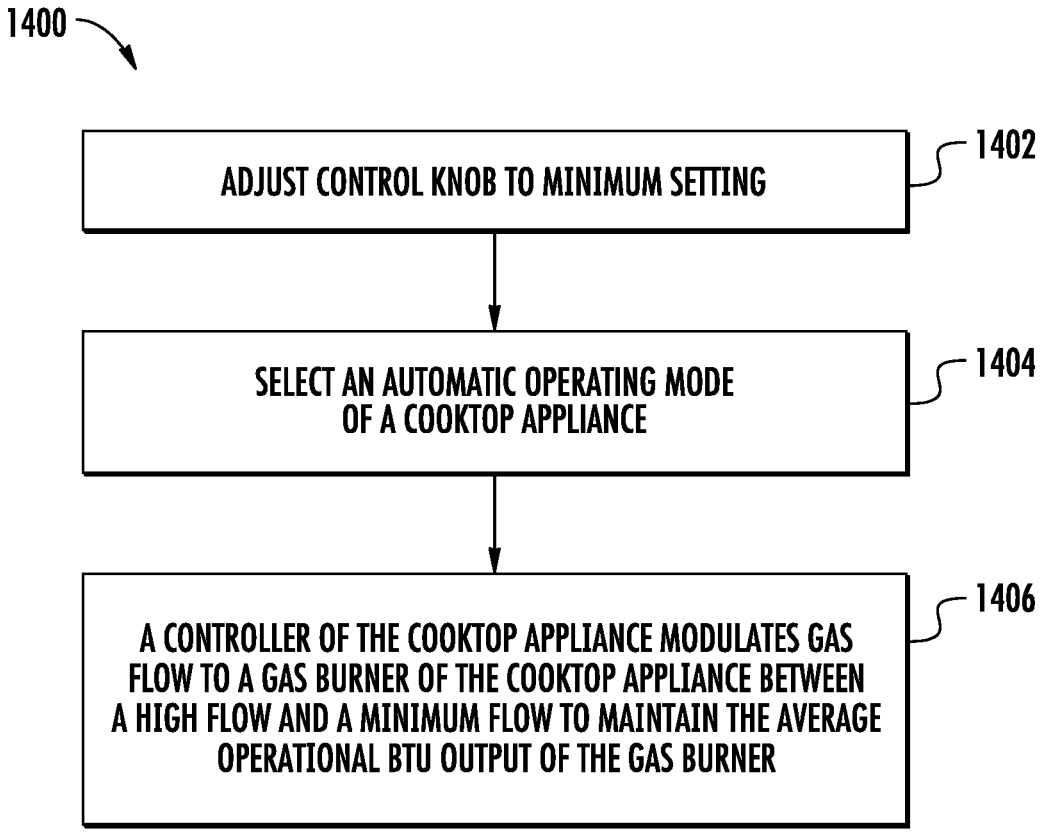
FIG. 10 is a flow chart of a method of using a gas burner of a cooktop appliance to heat a cooking implement at an average operational temperature below a minimum operational power output of the gas burner in accordance with embodiments of the present disclosure.

FIG. 2 illustrates a perspective front view of a portion of a control assembly 300 for regulating gas flow in a cooktop appliance (e.g., cooktop appliance 10). FIG. 3 illustrates a schematic view of the control assembly 300. Control assembly 300 is for a multi-burner gas burner 302 (e.g., as represented in FIGS. 3, 4, and 10) including a first gas burner (or first stage) 304 and a second gas burner (or second stage) 306. In an embodiment, the first gas burner 304 is a central burner and the second gas burner 306 is an outer burner that extends around at least a portion of a circumference of the first gas burner 304. In some such embodiments, second gas burner 306 may be arranged coaxially with respect to first gas burner 304. In further embodiments, second gas burner 306 is concentric with first gas burner 304. The first and second gas burners 304 and 306 can be in proximity to one another such that the flame from either of the first or second gas burners 304 or 306 can ignite gas passing through the other of the first or second gas burner 304 or 306 when the other of the first or second gas burner 304 or 306 is not actively ignited. In this regard, it may be possible to light the other of the first or second gas burner 304 or 306 without use of a spark generator.

Referring initially to FIG. 2, the control assembly 300 may include a knob 308. The knob 308 may be rotatable about an axis. As the knob 308 is rotated through the manual operating mode, the gas burner 302 associated with the knob 308 changes between a low setting and a high setting. For instance, as the knob 308 is rotated clockwise, the flame increases. Conversely, as the knob 308 is rotated counterclockwise, the flame decreases. The inverse arrangement is also possible, as would be understood in light of the present disclosure. The operator can set the desired temperature or a flame size at the gas burner 302 by turning the knob 308 to a desired rotational position. In a non-illustrated embodiment, the knob 308 may include a different user interface, such as a digital display, a switch, dial, slider, or the like. The operator can affect temperature at the gas burner 302 by adjusting the user interface.

In an embodiment, an automatic operating mode can be selected at the knob 308. For instance, the knob can have a range of rotational positions associated with the manual operating mode and at least one position associated with the automatic operating mode. Within the rotational positions associated with the manual mode, there may be a first range of rotational positions associated with single burner use and a second range of rotational positions associated with multi-burner use. In the first range of rotational positions, temperature control may occur through modulation of the first gas burner 304. In the second range of rotational positions, temperature control may occur through modulation of the second gas burner 306 alone or in combination with the first gas burner 304. By rotating the knob 308 to the position(s)

associated with the automatic operating mode, the control assembly 300 may automatically control the gas burner 302, e.g., a flame thereof, and thus the temperature at a cooking hardware 310 disposed thereon.

In another embodiment, automatic operating mode may be selectable through a secondary interface (not illustrated) other than the knob 308. For instance, the operator may initiate automatic operating mode through use of a secondary switch, dial, button, or the like.

The knob 308 may be coupled to a valve (e.g., primary valve 312) which controls gas flow from a manifold 314 receiving gas from a gas input 316. The valve 312 may be a manual valve controlled by a relative angular position of the knob 308. The knob 308 may also be coupled to a valve (e.g., primary valve 318) which controls gas flow from the manifold 314. The valve 318 may be a manual valve controlled by the relative angular position of the knob 308. The valves 312 and 318 can be in fluid communication with the first and second gas burners 304 and 306. In the depicted embodiment, the valve 312 supplies gas to the first gas burner 304 and the valve 318 supplies gas to the second gas burner 306. As previously described, the rotational position of the knob 308 can determine whether each of the valves 312 and 318 is open or closed and, if open, to what extent the valve 312 or 318 is open. When the knob 308 is in certain rotational positions the valve 312 is open and the valve 318 is closed. In other rotational positions, both of the valves 312 and 318 may be open. Additionally or alternatively, primary valve 312 and primary valve 318 may be combined as a single valve having two distinct and individually controllable outputs.

With both of the valves 312 and 318 in the open position (e.g., a maximum open position), gas can flow to the gas burner 302 at a maximum flow rate. With both of the valves 312 and 318 in the closed position, gas may not flow to the gas burners 302. While not wishing to be bound to any particular mode of operation, in certain embodiments, the valve 318 is only opened when the valve 312 is already open. That is, use of the second gas burner 306 only occurs when the first gas burner 304 is already in use.

In an embodiment, the manifold 314 may supply gas flow to one or more other control assemblies 300 which may be tapped into the manifold 314. These one or more other control assemblies 300 may supply gas to other gas burner (s) that are not pictured in FIG. 2.

In manual operating mode, the valves 312 and 318 may be selectively adjusted between the fully open and fully closed positions, or between any two or more locations therebetween, to modulate gas flow to the gas burners 302. By rotating the knob 308, the operator can effectively control the valves 312 and 318 so as to modulate gas flow.

Gas flowing to the first gas burner 304 may pass from the manifold 314 through the valve 312 into a primary line 320 of a first gas burner supply line 322 supplying the first gas burner 304. As the gas flow is modulated by the operator at the knob 308, a volumetric flow rate of gas through the primary line 320 to the first gas burner 304 changes, thus allowing the operator to modulate the heat supplied at the first gas burner 304.

Similarly, gas flowing to the second gas burner 306 can pass from the manifold 314 through the valve 318 into a primary line 324 of a second gas burner supply line 326 supplying the second gas burner 306. As the gas flow is modulated by the operator at the knob 308, a volumetric flow rate of gas through the primary line 324 to the second gas burner 306 changes, thus allowing the operator to modulate the heat supplied at the second gas burner 306.

The second gas burner supply line 326 is illustrated as including a secondary line 328. Use of terms primary and secondary as reference to the primary and secondary lines 324 and 328 is done for purpose of clarity and does not represent any associated criticality or order of function. The secondary line 328 may operate in parallel with the primary line 324. In manual operating mode, the secondary line 328 of the second gas burner supply line 326 is closed to prevent gas from passing through the secondary line 328. The secondary line 328 is in fluid communication with a valve 330 (which can be referred to as a flow control valve) which controls gas flow through the secondary line 328. When the control assembly 300 is operating in manual mode, the valve 330 may be closed such that all gas flow to the second gas burner 306 passes through the primary line 324. The valve 330 may be an electronic valve (also referred to as an e-valve) or include one or more non-manually controlled features.

The primary and secondary lines 324 and 326 of the second gas burner supply line 326 may be joined together at a junction 332. The junction 332 may be located downstream of the primary and secondary lines 324 and 326. The junction 332 may be in fluid communication with a sum line 334 which can extend from the junction 332 to the second gas burner 306 in the direction shown by arrow 336. In certain instances, the sum line 334 may extend an entire distance between the junction 332 and the second gas burner 306. That is, the sum line 334 may be coupled directly with the second gas burner 306. In other instances, one or more secondary gas lines (not illustrated) may be disposed between the sum line 334 and the second gas burner 306. In manual operating mode, gas flow through the sum line 334 may originate from the primary line 324 and be controlled by the valve 318 through the knob 308. In automatic operating mode, gas flow through the sum line 334 may originate from both the primary line 324 and the secondary line 328 and be controlled by at least the valve 330 as described in greater detail below.

The cooking hardware 310 may be selectively disposed at the gas burner 302. For instance, the cooking hardware 310 may be selectively disposed on a grate or other similar support surface such that the cooking hardware 310 is above, or generally above, a flame 338 emitted from the gas burner 302. In this regard, the cooking hardware 310 may be heated by the gas burner 302.

The control assembly 300 may include a control system 340 for automatically controlling a temperature of the cooking hardware 310 through regulating the gas flow rate to the gas burners 302. The control system 340 can be at least partially integrated into the control assembly 300, the cooking hardware 310, or both. In an embodiment, the cooking hardware 310 may include one or more sensors 342 configured to sense a temperature of the cooking hardware 310, a substance (e.g., food) disposed in the cooking hardware 310, or the gas burners 302, as would be understood. In certain instances, the sensor(s) 342 may be integrated into the cooking hardware 310, such as at least partially embedded therein. In the depicted embodiment, the sensor 342 is removably disposed within a fluid 344 being heated by the gas burners 302.

The sensor(s) 342 may be coupled with a controller 346. For example, the sensor(s) 342 may be coupled with the controller 346 through a wired interface, a wireless interface, or a combination thereof. In the depicted embodiment, the sensor 342 is coupled with the controller 346 through a wired interface.

In certain instances, the sensor(s) 342 may communicate to the controller 346 to inform the controller 246 whether the cooking hardware 310 is present at the gas burners 302. Use of the controller 346 to control the gas burners 302 may change based on whether cooking hardware 310 is detected. For instance, the controller 346 may not allow for use of the automatic operating mode when the cooking hardware 310 is not present. Conversely, the controller 346 may allow for use of the automatic operating mode when the cooking hardware 310 is detected as being present.

The closed loop temperature control provided by the controller 346 may only be used when certain cooking hardware 310 is present. That is, the cooking appliance may only allow for use of the automatic operating mode when approved cooking hardware 310 is present. Approved cooking hardware 310 may generally correspond with cooking hardware 310 having integrated sensor(s) 342. Other cooking hardware (e.g., cooking hardware 310 lacking integrated sensor(s) 342) may not be used with the automatic operating mode.

To provide precise temperature control, the control assembly 300 may utilize the control system 340 which can operate in closed loop. The sensor(s) 342 can detect the temperature of a contained liquid, the cooking hardware 310, a substance being cooked, etc., including any combination thereof. The sensed temperature can be communicated to the controller 346 which can adjust the valve 330 in response thereto. By modulating the valve 330, the secondary line 328 can have variable gas flow to the junction 332 and sum line 334. An input 348 may correspond to a desired temperature and can allow the operator to communicate the desired temperature to the controller 346. By way of example, the input 348 can include a rotatable dial, a knob, a digital interface, or the like. In a particular embodiment, the input 348 can include a dial that is coaxially rotatable with the knob 308. By adjusting the input 348, the operator can effectively set the temperature at the gas burners 302 without requiring the operator to manually modulate the gas flow using the knob 308. In this regard, gas flow to the gas burners 302 may be controlled to achieve a precise temperature.

In certain instances, when operating in automatic operating mode, the primary line 324 of the secondary gas burner line 326 may be closed. For instance, the primary line 324 can be closed by the valve 318.

When operating in automatic operating mode, the secondary line 328 may operate as a modulated gas flow line. That is, gas flow rate supplied to the second gas burner 306 may be controlled by modulating gas flow through the valve 330. The valve 330 can modulate gas flow through the secondary line 328. Thus, gas flow through the sum line 334 may vary between no gas flow (e.g., when the valve 330 is closed) and a maximum gas flow rate provided by the maximum gas flow rate through the secondary line 328 when the valve 330 is fully open. Since the valve 330 is controlled by the controller 346 (e.g., the relative position of the valve 330 is adjusted by the controller 346), the controller 346 can modulate the gas flow to a flow rate between the off and a maximum gas flow rate. Thus, the controller 346 can affect temperature at the cooking hardware 310 between a minimum temperature and a maximum temperature. Since the controller 346 can operate in closed loop (e.g., receive temperature information from the sensor(s) 342 and adjust in response thereto), the controller 346 can effectively adjust the gas flow rate to maintain the temperature at the cooking hardware 310 at the desired temperature provided at the input 348.

In the embodiment depicted in FIGS. 2 and 3, the first gas burner 304 operates at a fixed gas flow rate and the second gas burner 306 operates at a variable gas flow rate when the cooking appliance is in automatic operating mode. The variable gas flow rate will be explained in more detail below.

FIGS. 4 to 7 illustrate an exemplary view of the knob 102, 308 in accordance with an embodiment. The knob 102, 308 may be generally rotatable about an axis 600. The input 216, 348 may also be rotatable about an axis. The axis of the input 216, 348 may be coaxial with the axis 600 of the knob 102, 308.

Figure 5:
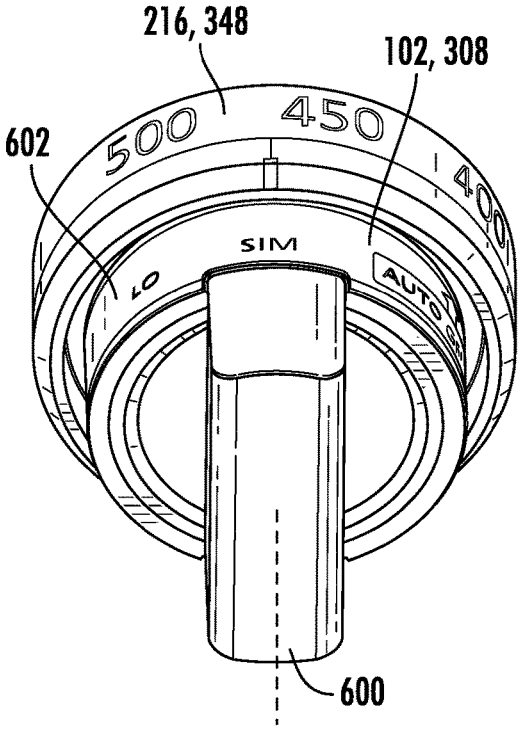
FIG. 5 is a perspective view of the knob for controlling the control assembly in accordance with embodiments of the present disclosure, as seen in a second position associated with the manual operating mode.
Figure 6:
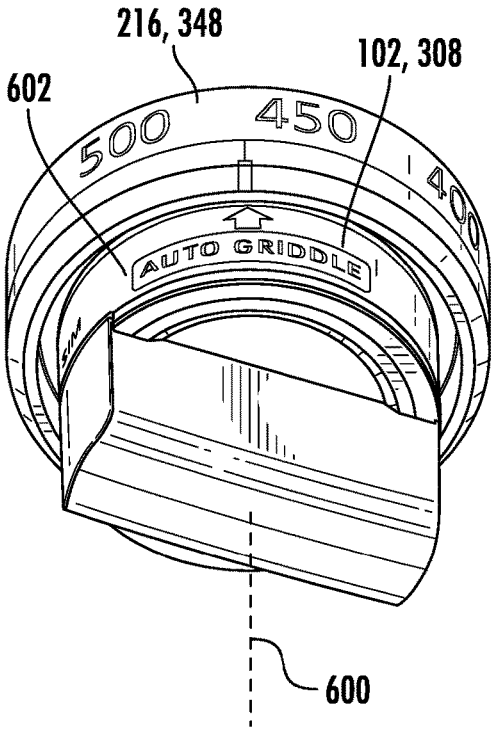
FIG. 6 is a perspective view of the knob for controlling the control assembly in accordance with embodiments of the present disclosure, as seen in a position associated with an automatic operating mode.
Figure 7:
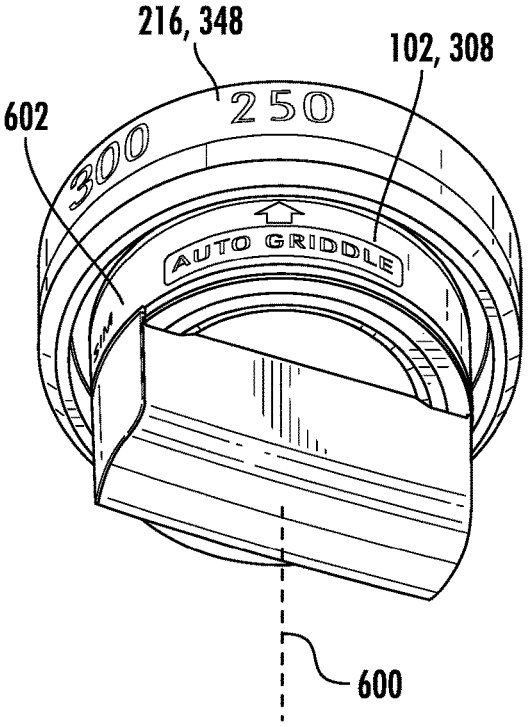
FIG. 7 is a perspective view of the knob for controlling the control assembly in accordance with embodiments of the present disclosure, as seen in a position associated with the automatic operating mode.

The knob 102, 308 can include indicia 602 which corresponds with a relative operating condition of the cooking appliance. For instance, the indicia 602 may correspond with a low temperature, marked as "LO", a high temperature, marked as "HI", a simmer temperature, marked as "SIM", and an automatic operating mode, marked as "AUTO GRIDDLE". The knob 102, 308 illustrated in FIG. 4 is disposed in the OFF position whereby the gas burners 200, 302 receive no gas flow. The knob 102, 308 illustrated in FIG. 5 is in a simmer mode whereby the cooktop appliance is operating in a manual mode at a simmer setting. The knob 102, 308 illustrated in FIG. 6 is in the automatic operating mode with the input 216, 348 set for approximately 465 degrees Fahrenheit. The knob 102, 308 illustrated in FIG. 7 is in the automatic operating mode with the input 216, 348 set for approximately 250 degrees Fahrenheit. The knob 102, 308 may be infinitely adjustable. That is, the knob 102, 308 may be adjustable to any location between rotational end points or stops. It should be understood that rotating the knob 102, 308 between the HI and SIM settings may allow for the operator to adjust the flame to any desired flame height. In certain instances, the cooktop appliance may include a tactile feedback when the knob 102, 308 is rotated from the manual operating mode to the automatic operating mode. The tactile feedback may include, for example, a detent or the like which causes a tactile indication when rotated past. It should be understood that the input 216, 348 may be set before or after the knob 102, 308 is set to the automatic operating mode. Moreover, the operator may adjust the input 216, 348 after the knob 102, 308 is in the automatic operating mode position, thereby allowing the operator to change the temperature at the gas burner.

Figure 8:
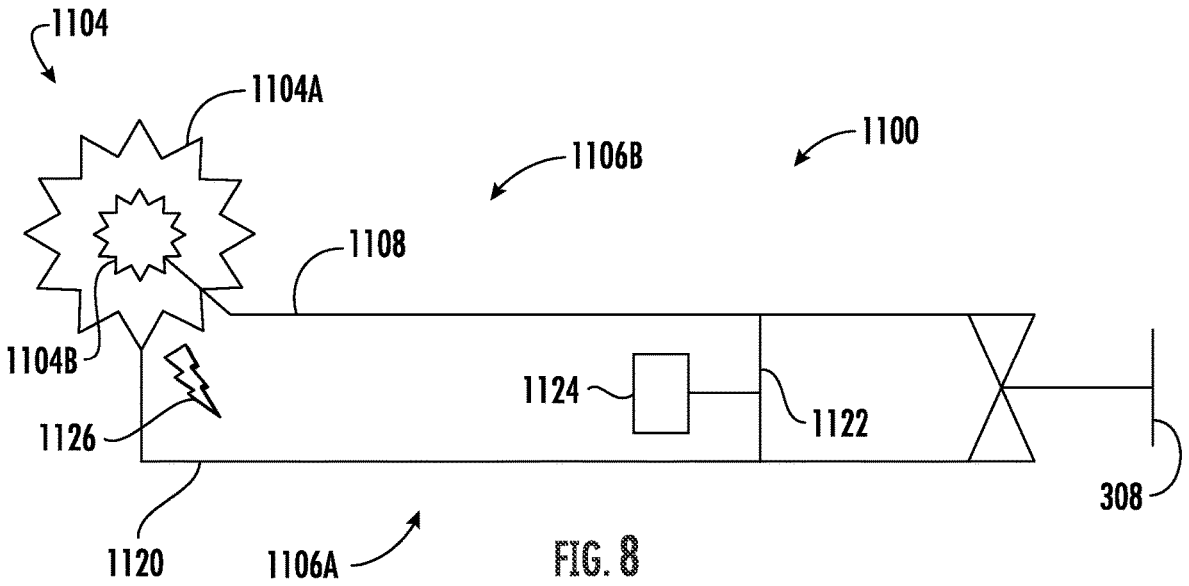
FIG. 8 is a schematic view of a cooktop appliance in accordance with embodiments of the present disclosure.

FIG. 8 illustrates a schematic view of an exemplary cooktop appliance in accordance with additional embodiments described herein. More particularly, FIG. 8 illustrates a control assembly used to control gas flow to one or more gas burners.

As previously described, certain cooking operations, such as sous vide cooking, require application of precise temperature over long durations of time. Typically, the temperatures required to perform these cooking operations are below the threshold capability of gas stovetops. For instance, traditional stove tops (e.g., gas stove tops) are generally capable of producing a minimum of 600 BTU/hour of heat. This is well above the temperatures required to perform sous vide cooking at low temperatures (e.g., 130 to 160 degrees Fahrenheit). Thus, gas stove tops have traditionally not be utilized for these cooking operations. Instead, kitchens often have additional equipment exclusively utilized for sous vide. Systems and methods described herein may advantageously be capable of operating at low temperatures (e.g., below the minimum 600 BTU/hour threshold of traditional stovetop appliances). Thus, the systems and methods described herein can advantageously replace or be used in place of additional, cumbersome kitchen equipment.

With reference to FIG. 8, a control assembly (or heating element assembly) 1100 is provided. Heating element assembly 100 may include a valve 1102 in fluid communication with a multi-gas burner 1104 through a burner supply line. For instance, multi-gas burner (FIG. 9) may include a first stage 1104A and a second stage 1104B. As described above, multi-gas burner may be any suitable gas burner, such as a multi-ring gas burner, an in-line dual burner including varying port sizes, or the like. The burner supply line may include a first burner supply line 1106A and a second burner supply line 1106B. For instance, first burner supply line 1106A may supply a fuel (e.g., natural gas, propane, etc.) to first stage 1104A of multi-gas burner 1104. Second burner supply line 1106B may supply fuel to second stage 1104B of multi-gas burner 1104. Second stage 1104B may extend around at least a portion of the circumference of first stage 1104A. Accordingly, first gas burner supply line 1106A may be in fluid communication with the first stage 1104A while second gas burner supply line 1106B may be in fluid communication with the second stage 1104B.

Valve 1102 may be referred to as a supply valve. Valve 1102 may be provided within a manifold (e.g., manifold 314). Thus, valve 1102 may be selectively controlled via a user input (e.g., control knob 308). As described above, a rotation of control knob 308 may selectively open valve 1102. Additionally or alternatively, as described above, valve 1102 may include multiple outlet ports. For instance, a first outlet port may be fluidly connected with first gas burner supply line 1106A and a second outlet port may be fluidly connected with second gas burner supply line 1106B.

Figure 9:
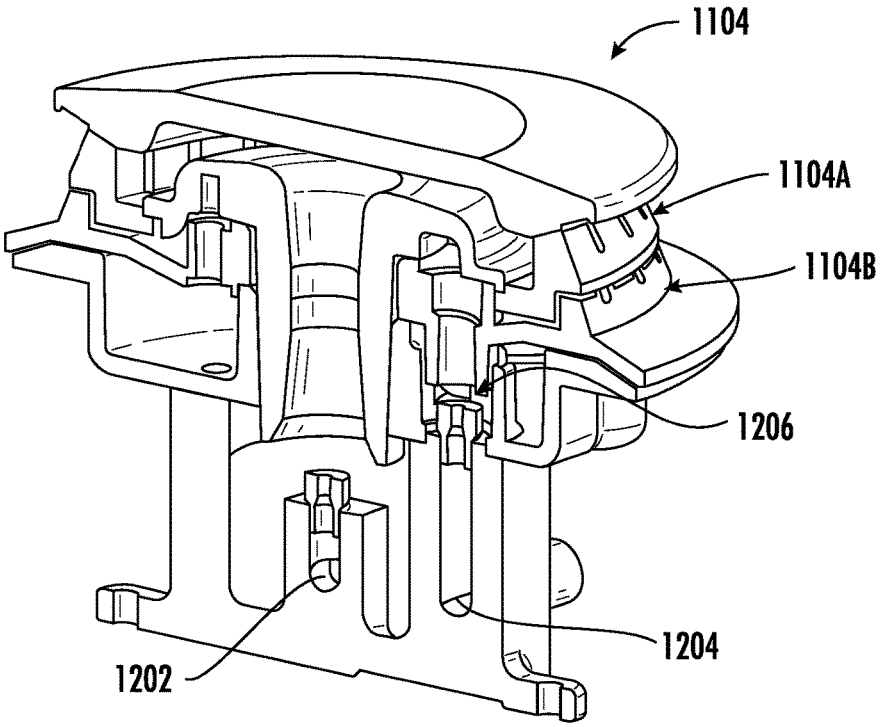
FIG. 9 is a perspective cut-away view of a multi-gas burner according to exemplary embodiments of the present disclosure.

Referring briefly to FIG. 9, first stage 1104A may include a first gas inlet 1202 and second stage 1104B may include a second gas inlet 1204. As described above, multi-gas burner 1104 may be operated according to an automatic control (e.g., incorporating feedback from, for example, sensor 342). Accordingly, at least one of first stage 1104A or second stage 1104B may be operated as a modulated gas line. For at least one example, first stage 1104A is operated as the modulated gas line. Thus, second stage 1104B may be operated as a fixed gas line. Second stage 1104B may provide a fixed power output. In detail, a maximum flow or quantity of the fuel supplied to second stage 1104B may be limited by a size (e.g., cross-sectional diameter) of an orifice 1206 (e.g. provided within second gas inlet 1204). Thus, regardless of a rotation position of control knob 308, the maximum heat output of second stage 1104B (e.g., a minimum or "LO" setting for multi-gas burner 1104) may be dictated by the size of orifice 1206. In other words, the heat output for second stage 1104B alone may be fixed. First gas inlet 1202 may thus be variable (e.g., according to a rotation position of control knob 308). For instance, first gas inlet 1202 may define an orifice (e.g., cross-sectional area) large enough to allow a constant manifold pressure (e.g., flow or quantity of fuel) to be introduced or supplied to first stage 1104A (e.g., during a manual operation). For one example, when control knob 308 is at a "MAX" setting, the full manifold pressure is supplied to first stage 1104A. Additionally or alternatively, first stage 1104A may experience a lower fuel pressure according to an adjustment to control knob 308 (e.g., when rotated to the "MIN" setting).

A spark generator 1126 may be provided at multi-burner gas burner 1104. Spark generator 1126 may include a single spark generator or a multi-spark generator with each spark generator of the multi-spark generator corresponding with a different one of the first and second gas burners 1104A or 1104B. As would be understood in light of the above disclosure, the heating element assembly 1100 may further include a control system which can monitor the temperature of the cooking hardware (e.g., cooking hardware 202, 310) at the multi-burner gas burner 1104 and regulate the heating element assembly 1100 according to a desired temperature.

Referring back to FIG. 8, heating element assembly 1100 may include a connection line 1122. Connection line 1122 may fluidly connect first gas burner supply line 1106A with second gas burner supply line 1106B. In detail, first and second gas burner supply lines 1106A and 1106B may be provided in fluid parallel with each other. Connection line 1122 may provide fluid communication between first gas supply line 1106A and second gas supply line 1106B. Connection line 1122 may be provided downstream from valve 1102. Accordingly, fuel supplied to first gas supply line 1106A may be selectively supplied to second gas supply line 1106B, and fuel supplied to second gas supply line 1106B may be selectively supplied to first gas supply line 1106A.

A connection line valve 1124 may be provided on connection line 1122. In detail, connection line valve 1124 may be positioned between first gas supply line 1106A and second gas supply line 1106B. Additionally or alternatively, connection line valve 1124 may be positioned between manifold 314 and multi-gas burner 1104. Connection line valve 1124 may be an e-valve to selectively open and close connection line 1122. According to some embodiments, connection line valve 1124 is a solenoid valve. Connection line valve 1124 may be operably coupled to a controller (e.g., controller 346). Accordingly, the controller may selectively open connection line valve 1124. For instance, connection line valve 1124 may be provided as a normally closed (NC) valve (e.g., no fluid communication between first gas supply line 1106A and second gas supply line 1106B). The controller may thus determine (e.g., according to one or more inputs from control knob 308, sensor 342, etc.) a proper time to open connection line valve 1124.

In the case of an automatic (e.g., modulated) operation, valve 1102 may close first gas burner supply line 1106A. As described above, a manifold pressure of fuel may be initially supplied through second gas burner supply line 1106B. However, since second gas inlet 1204 is orifice limited (e.g., at orifice 1206), only the minimum flow is supplied into second stage 1104B. According to one or more inputs from sensor 342, additional heat may be required at multi-gas burner 1104 at varying times throughout a cooking operation. When additional heat is required, the controller may open connection line valve 1124. When connection line valve 1124 is opened, the fuel is supplied into each of second gas supply line 1106B and first gas supply line 1106A (e.g., via connection line 1122). Since first gas inlet 1202 is fluidly connected directly with the manifold (e.g., is not orifice limited), the manifold pressure of fuel may thus be supplied to first stage 1104A. Advantageously, an automatic cooking operation may be easily controlled with a first valve (e.g., supply valve 1102) provided in a manifold and connected to two gas supply lines (e.g., first gas supply line 1106A and second gas supply line 1106B) and a second valve (e.g., connection line valve 1124) provided between first gas supply line 1106A and second gas supply line 1106B.

FIG. 10 illustrates a flow chart of a method 1400 of using a gas burner of a cooktop appliance to heat a cooking implement at an average operational temperature below a minimum operational power output of the gas burner. The method 1400 includes a step 1402 of selecting an automatic operating mode of the cooktop appliance. The step 1402 of selecting the automatic operating mode may be performed at a user selectable interface, such as a knob, used to adjust the cooktop appliance. The method 1400 may include a step 1404 of adjusting the control knob to a minimum power setting (e.g., of the supply valve). The method 1400 further includes a step 1406 of a controller of the cooktop appliance modulating gas flow to the gas burner between a high flow and a minimum flow to maintain an average operational power (BTU) output of the gas burner (e.g., via connection line valve 1124). As used herein, average operational power output is a measure of total BTU output over a duration of time divided by the duration of time. Thus, for example, if the gas burner has an ON output of 10000 BTU/hour and is ON for half of the time, the average operational power output is approximately 5000 BTU/hour. By modulating gas flow between a single stage (e.g., second stage 1104B) and a dual stage (e.g., first stage 1104A and second stage 1104B together, where the first stage is cycled between ON and OFF), the actual output achievable at the gas burner can be any output which can be achieved between the gas burner's lowest and highest power ratings during manual operation.

In certain instances, the method 1400 can further include a step of detecting a temperature corresponding to the gas burner (e.g., at the gas burner or a cooking implement thereon) and modulating gas flow. Modulating the gas flow can include modulating the gas flow to each of the first stage (1104A) and the second stage (1104B) when the detected temperature is below a desired temperature and modulating the gas flow of the first stage (1104A) to the off-state when the detected temperature is above the desired temperature. The step 1404 of modulating the gas flow can be performed in view of the detected temperature.

Systems and methods described herein can allow an operator to use a cooktop appliance in manual operating mode and automatic operating mode. The system can utilize closed loop feedback to maintain actual temperature at cooking hardware within a prescribed tolerance of a desired temperature (e.g., within +/−2 degrees Fahrenheit, such as within +/−1 degrees Fahrenheit, such as within +/−0.5 degrees Fahrenheit, such as within +/−0.25 degrees Fahrenheit, such as within +/−0.1 degrees Fahrenheit). In certain instances, the cooktop appliance can pulse the flame generated at the cooktop to maintain temperatures of the cooking utensil. In accordance with one or more embodiments, the cooktop appliance does not require incremental adjustments (e.g., compared to typical manually operated appliances) when converting the appliance between different fuel types, e.g., NG and LP, thus minimizing operator error during installation and setup and reducing operator time. These and other advantages of the systems and methods described herein are not found in traditional cooktop appliances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance comprising:
- a cooktop;
- a user interface provided on the cooktop;
- a manifold provided within the cooktop, the manifold comprising a gas input and a supply valve;
- a first burner supply line extending from the manifold, wherein the first burner supply line is operated as a modulated gas flow line;
- a second burner supply line extending from the manifold in fluid parallel with the first burner supply line, wherein the second burner supply line is operated as a fixed gas flow line;
- a multi-stage gas burner, the multi-stage gas burner comprising:
  - a first stage fluidly connected to the manifold via the first burner supply line; and
  - a second stage fluidly connected to the manifold via the second burner supply line;
- a connection line fluidly connecting the first and second burner supply lines;
- a connection line valve provided on the connection line between the manifold and the multi-stage gas burner; and
- a controller operably coupled with the connection line valve, the controller being configured to selectively open the connection line valve.

2. The cooking appliance of claim 1, wherein the connection line valve comprises a solenoid valve.

3. The cooking appliance of claim 1, wherein the supply valve is provided upstream from the connection line valve and is fluidly connected with the first burner supply line and the second burner supply line, and wherein the supply valve is operably coupled with the controller.

4. The cooking appliance of claim 3, wherein the user interface comprises:
- a user input, the user input comprising at least one control knob operably coupled to the supply valve.

5. The cooking appliance of claim 4, wherein the controller selectively opens the connection line valve based on a rotational position of the at least one control knob.

6. The cooking appliance of claim 4, wherein the first burner supply line is controllable by the user input.

7. The cooking appliance of claim 6, wherein a maximum flow input to the second stage of the multi-stage gas burner is restricted by a cross-sectional area of a gas input along a flow direction.

8. The cooking appliance of claim 4, further comprising:
- a sensor configured to detect a temperature corresponding to the multi-stage gas burner, the sensor being operably connected with the controller.

9. The cooking appliance of claim 8, wherein the controller selectively opens the connection line valve based on a detected temperature at the multi-stage gas burner via the sensor.

10. A heating element assembly comprising:
- a manifold comprising a gas input and a supply valve;
- a first burner supply line extending from the supply valve, wherein the first burner supply line is operated as a modulated gas flow line;
- a second burner supply line extending from the supply valve in fluid parallel with the first burner supply line, wherein the second burner supply line is operated as a fixed gas flow line;
- a multi-stage gas burner, the multi-stage gas burner comprising:
  - a first stage fluidly connected to the first burner supply line; and
  - a second stage fluidly connected to the second burner supply line;
- a connection line fluidly connecting the first and second burner supply lines;

a connection line valve provided on the connection line between the manifold and the multi-stage gas burner; and a controller operably coupled with the connection line valve, the controller being configured to selectively open the connection line valve.

11. The heating element assembly of claim 10, wherein the connection line valve comprises a solenoid valve.

12. The heating element assembly of claim 10, further comprising:

a supply valve provided within the manifold upstream from the connection line valve and fluidly connected with the first burner supply line and the second burner supply line, the supply valve being operably coupled with the controller.

13. The heating element assembly of claim 12, further comprising:

a user input, the user input comprising at least one control knob operably coupled to the supply valve.

14. The heating element assembly of claim 13, wherein the controller selectively opens the connection line valve based on a rotational position of the at least one control knob.

15. The heating element assembly of claim 13, wherein the first burner supply line is controllable by the user input.

16. The heating element assembly of claim 15, wherein a maximum flow input to the second stage of the multi-stage gas burner is restricted by a cross-sectional area of a gas input along a flow direction.

17. The heating element assembly of claim 13, further comprising:

a sensor configured to detect a temperature corresponding to the multi-stage gas burner, the sensor being operably connected with the controller.

18. The heating element assembly of claim 17, wherein the controller selectively opens the connection line valve based on a detected temperature at the multi-stage gas burner via the sensor.

* * * * *